US005379478A

United States Patent [19]

Vosbikian

[11] Patent Number: 5,379,478

[45] Date of Patent: Jan. 10, 1995

[54] SWIVEL JOINT ASSEMBLY FOR A DUST MOP

[75] Inventor: Peter S. Vosbikian, Moorestown, N.J.

[73] Assignee: Quickie Manufacturing Corporation, Cinnaminson, N.J.

[21] Appl. No.: 993,138

[22] Filed: Dec. 18, 1992

[51] Int. Cl.[6] ..... A47L 13/256

[52] U.S. Cl. ..... 15/147.2; 15/144.1; 15/145; 15/229.8; 403/13

[58] Field of Search ..... 15/145, 143.1, 144.1, 15/228, 229.1, 229.6, 229.7, 229.8, 229.9, 147.1, 147.2, 176.1, 176.6, 172; 403/13, 14, 245, 246, 263, 230; 81/177.7, 177.85; 16/DIG. 24, 223, 265, 266

[56] References Cited

U.S. PATENT DOCUMENTS

| | | | |
|---|---|---|---|
| 2,801,434 | 8/1957 | Vosbikian et al. | 15/144.1 |
| 2,966,689 | 7/1961 | Antonucci, Jr. | 15/144.1 |
| 3,314,699 | 4/1967 | Taylor | 403/14 |
| 3,395,415 | 8/1968 | Leland | 15/144.1 |
| 3,537,123 | 11/1970 | Leland | 15/144.1 |
| 3,651,534 | 3/1972 | Leland | 15/144.1 |
| 3,713,184 | 1/1973 | Leland | 15/229.8 |
| 4,466,152 | 8/1984 | Moss et al. | 15/145 |
| 4,754,516 | 7/1988 | Tremblay | 15/145 |

FOREIGN PATENT DOCUMENTS

| | | | |
|---|---|---|---|
| 276297 | 2/1966 | Australia | 15/144.1 |

*Primary Examiner*—Stephen F. Gerrity
*Assistant Examiner*—Tony G. Soohoo
*Attorney, Agent, or Firm*—Eckert Seamans Cherin & Mellott

[57] ABSTRACT

A dust mop has a swivel joint for coupling a mop head to an elongated handle. A swivel base on the mop head has a swivel socket with a cylindrical passageway along an axis parallel to the plane of the mop head. The passageway is unrestricted at the rear and restricted at a front by a raised lip for axially locking a rod of a swivel connector arranged to pivot on the base and couple to the handle. The handle receptacle defines an angle relative to the swivel rod, this rod forming a cylindrical bearing member for rotatable reception in the passageway. A planar ramp is formed on an axial front of the front end of the swivel rod, to guide the ramp over the raised lip when the swivel connector is rotated to align the ramp to the lip. A circumferential groove is formed adjacent the end of the swivel rod for receiving the lip. The swivel rod is flattened from the ramp rearwardly, along a transverse chordal surface aligned to the ramp, preferably tapering out to the full radius of the cylinder. A rib spaced axially from the raised lip cooperates with the tapering surface to lift the ramp at the lip. The device is easily assembled provided the ramp is first aligned to the raised lip. The ramp faces the extension of the handle, and thus only faces the lip when the handle is upside down.

19 Claims, 2 Drawing Sheets

SWIVEL JOINT ASSEMBLY FOR A DUST MOP

BACKGROUND OF THE INVENTION

1. Field of the Invention

The invention relates to cleaning apparatus, and in particular dust mops with a plurality of dust gathering yarns. More specifically, the invention provides an easily and securely assembled swivel joint assembly for operatively attaching or detaching a dust mop head and a dust mop handle, that when assembled permits the head and the handle to swivel relative to one another for use of the dust mop.

2. Prior Art

Dust mops are well known for cleaning in and about the home and commercial and industrial buildings. Such mops characteristically employ a plurality of individual dust gathering yarns connected to a mop head, to be passed over smooth or rough surfaces in a dry or damp condition, to thereby gather and retain dust in and between the yarns. An elongated handle is conventionally attached to the dust mop head at a pivotal connection, to facilitate ease in operation by permitting the mop head to conform to a surface regardless of the angle between the surface and the handle.

The pivotal connection between the mop head and the mop handle allows the angle of the mop head to conform, for example, to a horizontal lower surface such as a floor or an elevated surface such as a cabinet. The mop head can just as easily conform to a ceiling or to a vertical surface. Whereas the connection swivels, the user can stand at one spot and pass the mop head along a line perpendicular to the swivel axis. The mop head remains on the surface as the relative angle of the handle and head varies between its extremes. The swivel axis can be parallel to the plane of the mop head and in the plane of the handle, typically with a bend in the handle adjacent the mop head providing a comfortable angle of operation.

U.S. Pat. No. 4,245,368 (Cotey et al) discloses a dust mop assembly having a swivel joint assembly construction comprising an upper swivel socket means integrally molded or otherwise formed on the top surface of the mop head (i.e., on the side opposite the working face of the mop head). The upper swivel socket means defines a cylindrical passageway with an unrestricted rear opening and a restricted front opening. A swivel connector has a receptacle for the end of the mop handle, and an insertable part that is angularly displaced relative to the axis of the handle. The insertable part is removably inserted into the swivel socket through the unrestricted rear opening of the upper swivel socket means until it snaps into a locked position against the restricted front opening. As thus attached, the swivel connector and socket allow swivelling while retaining the mop head on the handle.

In Cotey, a secure, rotatable interconnection is obtained in that the swivel connector is split at the insertable part, having two connecting ends spaced by a slot. The two ends are urged inwardly as the inserted swivel connector passes axially of the socket, through an inward peripheral lip at the restricted front opening. The two connecting ends snap resiliently outward upon passing the lip, to snap-lock the swivel connector axially relative to the swivel socket means while allowing swivelling. The split connector ends of the swivel connector have radially protruding grasping projections shaped to pass the peripheral lip. Whereas the projections also extend forwardly, insertion can be assisted by squeezing together the projections manually. The projections likewise can be squeezed together to allow retraction of the swivel connector from the socket when disconnecting the swivel joint.

It is also known in swivel joint assemblies for dust mops and the like to provide a base that is detachable from the dust mop head, whereby the head is removable from the base for laundering. The base can comprise the swivel socket means and structures that couple to the mop head, e.g. at pockets therefor.

Another form of known swivel connector for a dust mop head and dust mop handle has a swivel connector in the form of a rod means generally defining a cylindrical bearing member, with a circumferential groove. The groove creates front and rear radially larger portions of the rod, which forms the male connector part and inserts forwardly into the swivel socket means. The swivel socket or female part defines a cylindrical passageway with an unrestricted rear opening. At the front opening a raised lip snap-locks into the groove, axially fixing the rod means to the socket while allowing swivelling.

There are shortcomings in known swivel joint assemblies having a circumferential groove that interacts with a raised lip as described, to axially lock in the cylindrical passageway while allowing pivoting. It is typically difficult and awkward to force the front portion of the circumferentially grooved connector end over the raised lip, particularly because the connector end is rather securely positioned by the socket. It would be possible to use a relatively lower lip and/or shallower circumferential groove to make it easier to pass the connector end over the lip. However, once the connector end is successfully inserted, such a joint would that much more easily become inadvertently detached. Therefore, known swivel joint assemblies that are reasonably easy to assemble typically tend to unlock inadvertently and come apart during dusting operations, especially operations involving swivelling. This is of course frustrating and inconvenient to the user.

It would be desirable to optimize a swivel joint for aspects of assembly, such as ease of insertion and locking, and also to optimize the joint for use, such as smooth rotation and resistance to detachment. Such a joint would also be easy to make and to assemble during manufacture. When assembled, the joint would be freely rotatable but axially secure, especially during dusting actions.

Furthermore, the optimal joint for a dust mop head and dust mop handle should be sufficiently durable to maintain the structural integrity and advantageous aspects of the swivel joint assembly despite continuous use of the dust mop, and multiple changes of the dust mop head.

SUMMARY OF THE INVENTION

It is an object of the invention to provide a swivel joint assembly for a dust mop which is easily assembled.

It is another object of the invention to provide a rotatable swivel joint assembly that is secure along the swivelling axis against inadvertent disassembly.

It is another object of the invention to provide a swivel joint assembly for a dust mop which maintains its structural integrity after repeated use and interconnection and disconnection of a dust mop head.

It is another object of the invention to provide an optimal swivel joint assembly for a dust mop, of the type having a base defining a swivel socket and a swivel connector including a swivel rod with a circumferential groove, the end of this rod defining a ramp, preferably at a predetermined angle of the connector relative to the socket, to facilitate insertion of the swivel rod in the forward direction, but resisting retraction.

It is a further object of the invention to provide a dust mop construction with a swivel base including a swivel socket having a raised cylindrical passageway shaped to interact with a ramp on the inserted connector end.

These and other objects are met by a swivel joint assembly according to the invention, with a swivel base and a swivel connector. The swivel base generally defines a plane and is structured for connection to a mop head. A swivel joint on the base is arranged for attaching a mop handle, and includes socket means on the base and a connector rod including means for attachment to the handle. The connector rod locks axially in the socket, while permitting relative rotation around the socket axis. The swivel socket means comprises side walls raised over the base, and a cylindrical interior cavity with an unrestricted rearward opening. A forward opening is restricted by a raised lip for engaging a groove defined by the connector rod.

The swivel connector rod and handle attachment means are coupled along an angular bend relative to an elongation axis of the handle. The swivel connector rod, at a forward end, is axially secured by insertion in the socket, while remaining freely rotatable relative to the swivel socket means on the base.

The swivel connector rod comprises a cylindrical bearing member defining a length and terminating at a connector end having a circumferential groove spaced from the extreme distal end of the connector rod. The circumferential groove defines a depth, and adjacent the groove a transverse chordal surface is formed, extending axially along the connector rod on both sides of the circumferential groove. The distal end of the connector rod defines a ramp means in a forward or insertion direction, aligned to the transverse chordal surface, for easily passing the end of the connector rod over a raised lip on the base. The raised lip protrudes from the base carrying the mop head, to snap into the groove after passing the ramp, thereby axially securing the connector rod in the socket, while freely permitting pivoting. The transverse chordal surface preferably is arranged parallel to the base and the peripheral groove when the connector rod is pivoted to a less-frequently used rotational position of the connector rod, for example the position characteristic of dusting an elevated horizontal surface. As a result of the chordal surface, which radially shortens the circumferential groove on one side of the connector rod, the connector rod more easily passes axially over the lip when appropriately aligned. Thereafter in use the chordal surface is generally opposite from the lip. The device is easily assembled, and axially secure.

These and other advantages of the invention will become more readily apparent in connection with the following description of certain embodiments of the invention, disclosed as non-limiting examples.

BRIEF DESCRIPTION OF THE DRAWINGS

There are shown in the drawings the embodiments of the invention as presently preferred. It should be understood that the invention is capable of embodiment in a number of specific arrangements in accordance with the disclosure herein, and reference should be made to the appended claims rather than the discussion of exemplary embodiments to assess the scope of the invention in which exclusive rights are claimed. In the drawings.

DETAILED DESCRIPTION OF THE EMBODIMENTS

Although specific terms respecting shapes, directions and the like are used in the following description for the sake of clarity, these terms are intended to assist in the description of the particular structure of the invention selected for exemplary illustration, and are not intended to define or limit the scope of the invention.

Figure 1:
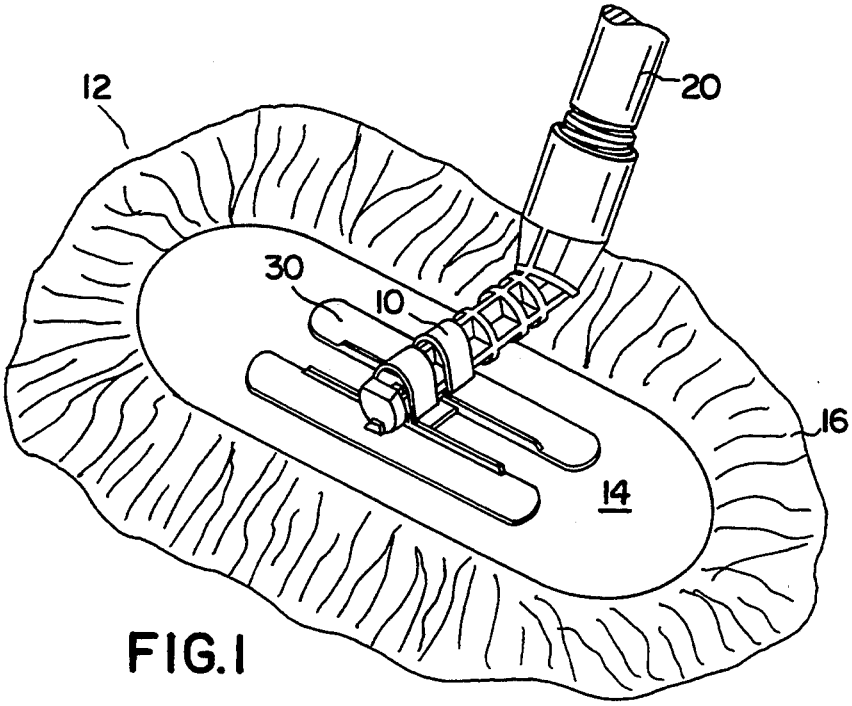
FIG. 1 is a perspective view of a dust mop arrangement according to the invention.
Figure 2:
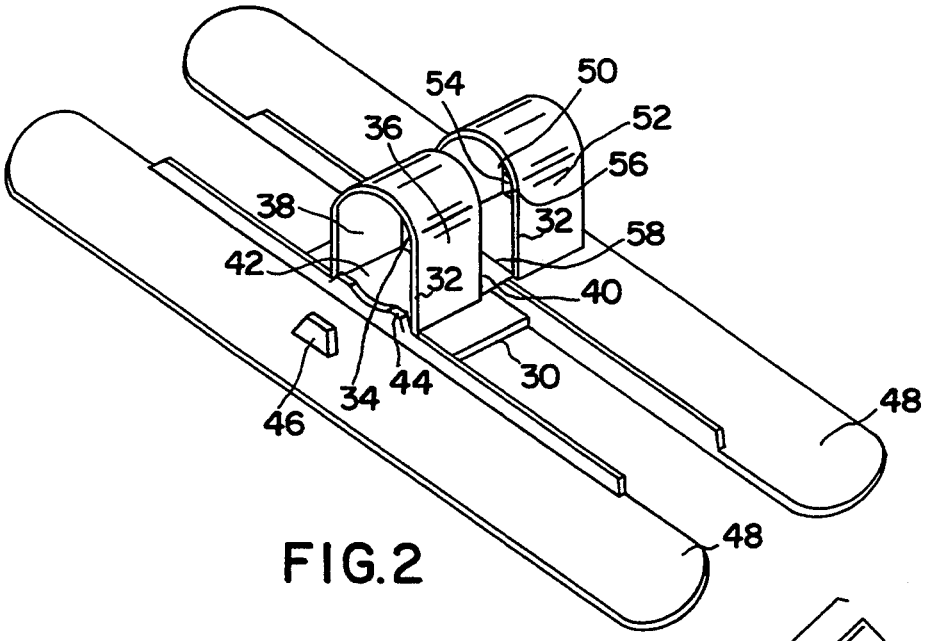
FIG. 2 is a perspective view of the base member according to FIG. 1, shown separate from the yarn carrying head.

A dust mop swivel joint assembly 10 according to the invention is a shown generally in FIG. 1. A dust mop 12 comprises a mop head 14 defining a generally planar surface and a plurality of dust gathering yarns 16 secured on an operative face of the mop head, i.e., the underside as shown in FIG. 1. The mop head 14 preferably has a swivel base part 30, shown separately in FIG. 2, which removably attaches to a yarn carrying part via lateral tongue portions that fit into pockets in the yarn carrying part. The swivel base part 30 may be a flexible plastic material that is deformable for guiding the tongue portions into the yarn carrying part.

The swivel base 30 has one or more swivel socket means 32 protruding on its upper surface for attaching a swivel connecting rod that is in turn attached to an end of the mop handle. The socket means can be integrally formed with a swivel base 30 formed in the upward surface of the mop head, for example in a central area of the tongues and/or at least partly between the tongues, such that the socket means is exposed on the top surface of the mop head. The base 30 and the socket means 32 are structured to accept the insertion of the connecting rod on the handle fitting in a manner that locks the joint along the axis defined by the swivel joint and allows relatively free rotation around this axis.

The swivel base 30 resides in a plane parallel to the operative surface of mop head 14. The swivel base 30 includes swivel socket means 32, which in the embodiment shown has two upwardly formed side walls 35 forming a cylindrical passageway 34. Accordingly, an interior cavity 38 is defined between the swivel base 30 and the side walls 35, having a radial extension, an unrestricted rear opening 40, and a restricted front opening 42. Adjacent the front opening is a raised lip 44 that protrudes upwardly from the swivel base 30. A raised axial stopper or abutment 46 may be provided forward of the raised lip 44. The base 30, side walls 35, lip 44 and stopper 46 are shaped and positioned to complement a swivel connector 60, shown separately in FIG. 3 and coupled to the mop head in FIG. 1. As received in the mop head, the swivel connector 60 is axially locked, and freely rotatable relative to the mop head.

Figure 4:
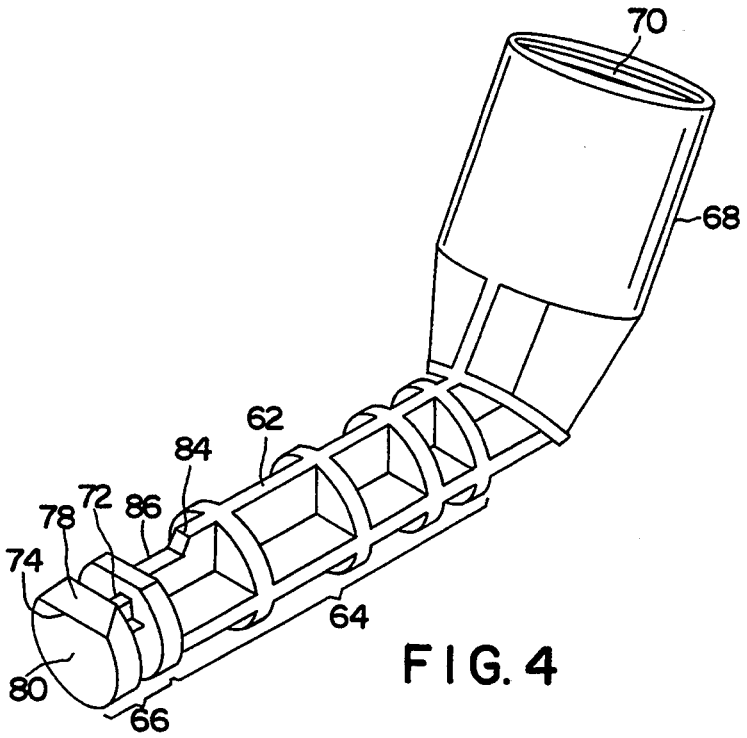
FIG. 4 is a perspective view of the coupling portion shown in FIG. 3.

The swivel connector 60 provides a connection for the mop handle, and can be internally threaded as shown in FIG. 4. The swivel connector 60 includes a swivel rod means 62 comprising a cylindrical bearing member 64 terminating at a circumferentially grooved connector end 66 to snap-fit securely into the swivel socket means 32 and to rotate therein to enable a universal dusting action over horizontal or vertical surfaces such as floors, walls, ceilings, elevated surfaces and the like. In passing the mop head over such surfaces, the user places the mop head parallel to and onto the surface, and moves the mop laterally relative to the swivel axis, thus causing the angle of the mop handle to vary relative to the mop head in a typical side to side movement.

Figure 3:
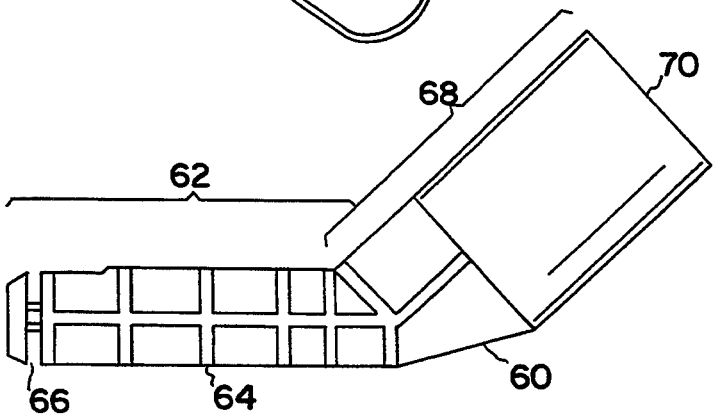
FIG. 3 is a side elevation showing the male portion of the swivel coupling fitted into the base of FIG. 2 for attaching the handle to the dust mop.
Figure 5:
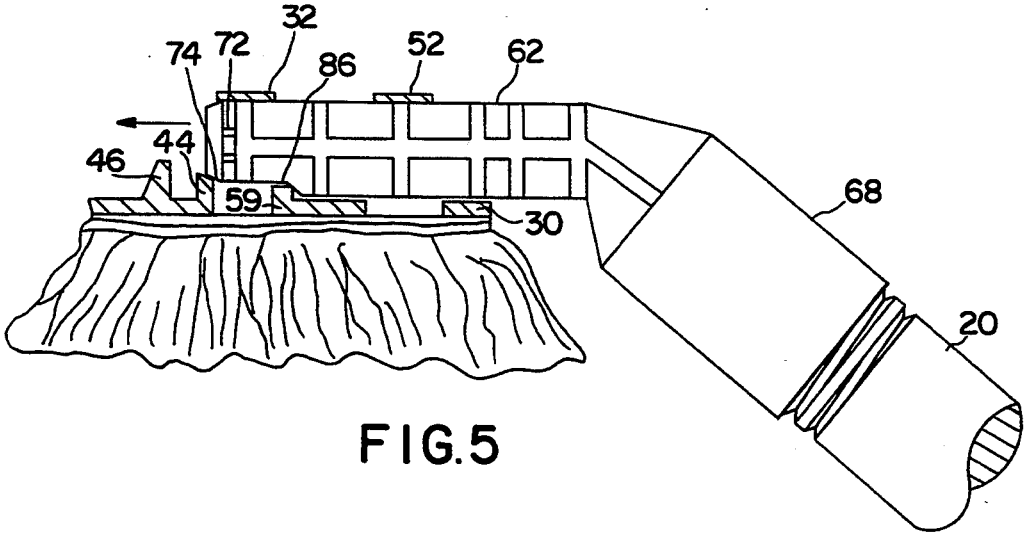
FIG. 5 is a partial side elevation view, the base member shown in longitudinal section along the axis of the swivel joint, illustrating insertion of the coupling portion of FIGS. 3 and 4 into the base, the handle extending toward the operative face of the mop head.

The mop handle connector or receptacle means 68 as shown in FIGS. 3–5 defines an angular bend between the swivel axis and the longitudinal extension of the mop handle 20. This angle is variable for the comfort of the user, and can be, for example, about 130°. The handle connector portion 68 is somewhat wider than the connecting rod part, and preferably the two are formed integrally using a ribbed arrangement of coupled discs as shown, to reduce weight and material.

The swivel base 30 includes mop head connector means 48, which in the embodiment shown are laterally protruding tongues, insertable in pockets in the mop head 14. The mop head connector means 48 are preferably integrally formed on the plane of the swivel base 30, preferably having planar extensions from the base, for insertion into the correspondingly sized and configured mop head swivel base receiving pockets. This arrangement allows manufacture of the swivel base 30 separately from mop head 14, and allows a user to disconnect a spent mop head easily, and to reconnect a new or laundered mop head.

The swivel socket means 32 on the surface of swivel base 30 forms a raised cylindrical passageway 34 defined by raised cylindrical side walls or arches 36. The interior cavity 38 thus defined is substantially cylindrical, and may have a flattened bottom conforming to the shape of the swivel base. The cylindrical passageway 34 is radially dimensioned to receive the swivel connector 60 in a bearing relationship that allows the mop head 14 to rotate easily relative to the mop handle 20 around the axis of the swivel joint, for use of the dust mop. The passageway 34 has an unrestricted rearward end 40 and a forward end 42 that is restricted so as to axially capture the swivel connector 60 while allowing it to rotate. The restricted forward end 42 of passageway 34 as shown includes an upwardly formed raised lip 44 that locks into a groove adjacent the forward or distal end of the swivel connector 60 to secure the swivel connector to the mop head, and thereby to lock the handle to the mop head.

The swivel connector 60 is formed in the embodiment shown to include a swivel rod means 62 defined by a series of bearing discs arranged perpendicular to the axial extension of the two are formed integrally using a ribbed arrangement of coupled discs as shown, to reduce weight and material.

The swivel base 30 includes mop head connector means 48, which in the embodiment shown are laterally protruding tongues, insertable in pockets in the mop head 14. The mop head connector means 48 are preferably integrally formed on the plane of the swivel base 30, preferably having planar extensions from the base, for insertion into the correspondingly sized and configured mop head swivel base receiving pockets. This arrangement allows manufacture of the swivel base 30 separately from mop head 14, and allows a user to disconnect a spent mop head easily, and to reconnect a new or laundered mop head.

The swivel socket means 32 on the surface of swivel base 30 forms a raised cylindrical passageway 34 defined by raised cylindrical side walls or arches 36. The interior cavity 38 thus defined is substantially cylindrical, and may have a flattened bottom conforming to the shape of the swivel base. The cylindrical passageway 34 is radially dimensioned to receive the swivel connector 60 in a bearing relationship that allows the mop head 14 to rotate easily relative to the mop handle 20 around the axis of the swivel joint, for use of the dust mop. The passageway 34 has an unrestricted rearward end 40 and a forward end 42 that is restricted so as to axially capture the swivel connector 60 while allowing it to rotate. The restricted forward end 42 of passageway 34 as shown includes an upwardly formed raised lip 44 that locks into a groove adjacent the forward or distal end of the swivel connector 60 to secure the swivel connector to the mop head, and thereby to lock the handle to the mop head.

The swivel connector 60 is formed in the embodiment shown to include a swivel rod means 62 defined by a series of bearing discs arranged perpendicular to the axial extension of the swivel connector 60, coupled by mutually perpendicular axially extending webs. In the space between the last two distal end discs, i.e., at the grooved connector end, the webs are radially smaller than the discs, thus forming a circumferential locking groove between the last two discs for engaging the raised lip 44. The restricted forward end 42 can also include an upwardly formed raised stopper 46 to abut the swivel connector 60 axially, thus stopping the circumferential groove in the swivel connector from passing over the raised lip in the forward direction, as might otherwise occur during mopping operations.

Preferably, the swivel socket means has means forming a second cylindrical passageway 50, also defined by raised cylindrical sidewalls 52 to form a cylindrical interior cavity 54 with unrestricted ends 56, 58. The second passageway 50 is axially spaced to the rear of the passageway 34 at which the swivel connector 60 locks axially, to provide further rotatable support for the swivel connector 60 by positioning the swivel rod means 62 inserted therein. The first passageway 34 in this embodiment is placed at the swivel base portion 30 and the second passageway 50 is placed on the rearward one of the tongue members arranged to fit in the mop head pockets. For ease of molding, gaps are left in the swivel base 30 and in the rearward tongue member under the respective arches defining the cylindrical passageways.

The raised lip 44 of the swivel base 30 can be made higher than known configurations, for example by 0.050 inch or more, which provides a very secure snap-lock connection with the grooved connector end 66 of swivel connector 60. The large lip also is a large structural element that helps to maintain the structural integrity of the swivel connection during use of a dust mop, as well as the device as a whole. The swivel base 30 preferably is molded of a plastic material, such as polypropylene or polyethylene, to desired configuration.

Using a relatively high locking lip can be expected to make the locking secure, but also would normally make the swivel connection very difficult to assemble and disassemble manually. However the invention also comprises a particular structure for the swivel connector 60, and in particular the distal rod portion of the swivel connector. The swivel connector 60 includes mop handle connector part 68, having a rearwardly open socket portion 70 of suitable size and configuration to receive the end of a conventional mop handle 20 in a secure manner. The mop handle 20 may be secured in the socket portion 70 by friction, by adhesive (not shown), by a staple, rivet or other mechanical fastener (not shown), or using a thread or similar conventional fastening. If desired, a spline arrangement (not shown) or locking key construction (not shown) could also be employed to secure the mop handle 20.

The mop handle connector means 68 of the swivel connector 60 terminates forwardly in swivel rod means 62 including a cylindrical bearing member 64 which is angularly offset from the axis of the handle, as defined by the handle connector part. In the embodiment shown, the cylindrical bearing member 64 is offset from the longitudinal axis of the mop handle connector means 68 at an obtuse angle of about 135°. The mop is thus conveniently applicable to a floor or the like with the mop handle 20 about 45° from vertical. The planar swivel base 30 thus rests flat on the floor at a space from the user.

The proximal part of the cylindrical bearing member 64 adjacent the handle coupling is radially sized to fit closely in the passageways 34, 50. As shown in FIG. 5, the bearing member is inserted forwardly into the swivel socket means 32 of the swivel base 30. The cylindrical bearing member 64 terminates at a circumferential groove connector end 66 having a circumferential groove 72 defining a depth which creates a forward portion 80 and a rearward portion 82 of the cylindrical groove connector end. A ramp means 74 is formed at the forward portion 80 of the groove connector end 66, defined by a transverse chordal surface 78 integrally formed on the front portion of the cylindrical groove connector end 66. The ramp means 74 provides an easier assembly of the swivel connector 60, namely the swivel rod means 62, and the swivel base 30, namely the swivel socket means 32, when the swivel connector 60 is oriented such that the ramp portion on the forward portion 80 is aligned to the raised lip 44. The ramp provides a planar sloping surface at the axial front of forward portion 80 for more easily passing over the raised lip 44. The ramp is not part of a conical formation, but is planar. The ramp is associated with a flattened radial side of the swivel connector 60, extending back from the top edge of the ramp to a point 84 where the connector is again cylindrical. Thus, the ramp portion and the flat face of the swivel connector 60 to the rear assist in snapping the end disc 80 over the lip 44. Once disc 80 passes over the lip, the lip snaps into groove 72, and can extend radially inwardly up to the radially shorter axial webs behind disc 80. The groove 72 is preferably substantially equal in depth to the height of lip 44 at all points around the swivel connector 60 except at the flattened face that meets the edge of the ramp. Therefore, as compared to known configurations, both the lip 44 and the groove 72 have quite long radial extensions, e.g., 0.050 inch more than would be practicable except for the ramp 74 and flattened face 84.

The ramp means 74 can be precisely planar or can have a rounded shape, provided the ramp means is restricted to a particular rotational position of the swivel connector. Preferably, the ramp is on the same side of the swivel rod as the extension of the handle (which is angled relative to the swivel rod axis). Therefore, as shown in FIG. 5, it is necessary to rotate the swivel connector to a position which would extend the handle toward the mop head in order to make use of the ramp. Although this position of the handle may be used occasionally, for example to dust the top of a cabinet or the like, it is a less-frequently used position of the handle. Thus the ramp is not in position to assist in detachment of the swivel rod from the swivel base in most operational positions of the handle.

The swivel connector and the swivel base preferably are integrally molded of a plastic material, such as polypropylene or polyethylene, including the connector rod portion and handle receptacle portion. The arrangement of the swivel rod, with spaced discs coupled by axial webs as shown, is strong but does not use a great deal of material. It would also be possible to form the swivel rod as a plug with a cylindrical surface, which plug could be solid or hollow.

Figure 6:
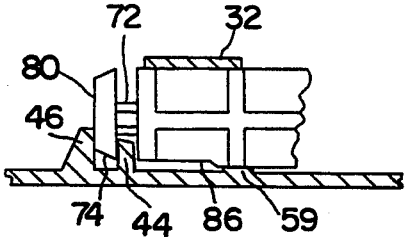
FIG. 6 is a partial section view corresponding to FIG. 5, showing the fully inserted coupling portion.
Figure 7:
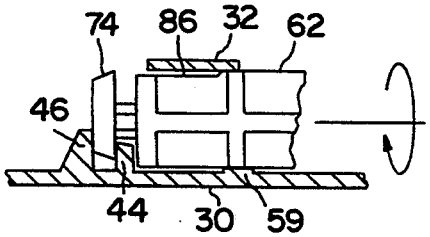
FIG. 7 is a partial section view corresponding to FIG. 6, showing the coupling in normal position, rotated 180° relative to the position in FIG. 6, i.e., in a position wherein the handle extends away from the operative side of the dust mop head.

FIGS. 5–7 show a particularly advantageous configuration for the swivel rod, and in particular the transverse chordal surface, that interacts with an additional rib 59 formed on the swivel base. As shown, the transverse chordal surface (i.e., a flat side or facet extending axially to the rear from the top edge of the ramp) joins to the cylindrical shape of the swivel rod at a taper 86. At the rear of the forward arch defining the passageway, rib 59 protrudes upwardly from the surface of the swivel base. When inserting the swivel rod into the passageway as seen in FIG. 5, the taper 86 encounters rib 59 at about the same point that the ramp 74 encounters raised lip 44. In other words, the distance between ramp 74 and taper 86 is substantially equal to the distance between the lip 44 and the rib 59. As a result, axially forward force on the swivel rod tends to lift the ramp over the lip.

As the ramp passes over the lip, the swivel rod snaps downwardly as shown in FIG. 6. Due to the ramp and the transverse chordal flattening, the swivel rod is radially shorter along the bottom in FIG. 6 than along the top, which normally would encourage the swivel rod to become detached. However, at this point of insertion the cylindrical part of the swivel rod to the rear of the taper has ridden up onto the rib 59, thus tending to push the distal end of the swivel rod more downwardly than in FIG. 5. Furthermore, in this position the handle faces toward the mop head. In its most-frequently used orientation the handle faces upwardly from the mop head, or dusting in narrow openings under furniture and the like the handle is arranged parallel to the plane of the swivel base. When the handle is rotated around the swivel axis to any position other than the downward position (FIGS. 5 and 6) where the ramp aligns with the lip, the ramp and transverse chordal surface do not come into play. In the usual position, including a handle-up position as shown in FIG. 7 as well as any position in which the handle may be inclined partly laterally, the full radial dimension of the cylindrical portion of the swivel rod is disposed to engage the lip 44 and the axial stop.

The swivel joint is easily assembled by simply pushing the swivel rod axially into the passageway, taking care to first align the handle coupling downwardly as in FIG. 5. The swivel rod snaps readily onto the raised lip due to the cooperation of the ramp, lip, taper and rib. The swivel rod need not fit unduly tightly in the passageway, with the advantageous result being that the mop head pivots freely as needed to conform to surfaces being dusted. When pivoted to the more frequently used positions including the handle-upright orientation of FIG. 7 or any position at which the ramp is angularly displaced from the lip 44, the axial locking of the swivel rod and the swivel base is at full strength, and it is most unlikely that the two will become inadvertently detached.

The invention as disclosed has only one ramp and transverse chordal surface. It would also be possible to provide more than one such surface, enabling the joint to be detached after rotating the handle to bring any of the ramps into alignment with the raised lip. For example, the opposite lateral sides of the connector rod could both have ramps and transverse chordal surfaces, whereby the joint would be detachable only when the handle is rotated to reside parallel to the plane of the mop head. Whereas the handle-down position is less frequently used for dusting, the arrangement shown in the drawings is preferred.

This invention having been disclosed, variations and additional embodiments in accordance with the invention will now be apparent to persons skilled in the art. Whereas the invention is not intended to be limited to the exemplary embodiments and will encompass a range of such variations, reference should be made to the appended claims rather than the foregoing specification to assess the scope of the invention in which exclusive rights are claimed.

I claim:

1. A mop swivel joint assembly, comprising:

a swivel base generally defining a plane and including means for attachment of mop material;

a swivel socket on the swivel base, the swivel socket having a cylindrical passageway, an unrestricted rearward opening and a restricted forward opening including a raised lip protruding from the swivel base to rotatably engage a swivel connector;

the swivel connector having a front end and a rear end, the rear end including a receptacle for a handle and the front end including a swivel rod, the swivel rod defining a substantially cylindrical bearing member including a grooved end having a circumferential groove adjacent the front end of the swivel rod; and, at least one ramp with a planar sloping surface at an axial forward portion of the grooved end of the swivel rod, wherein the ramp is disposed on a side of the swivel rod aligned to the raised lip only at a predetermined rotational position of the swivel rod in the cylindrical passageway, the ramp engaging the raised lip for passage into the circumferential groove when the swivel rod is at said rotational position, and being angularly spaced from the raised lip at other rotational positions, such that the swivel connector is rotated to said rotational position to align the ramp and the raised lip.

2. The mop swivel joint assembly of claim 1, wherein the swivel rod further comprises a flattened chordal portion extending axially rearwardly from an edge of the ramp to the cylindrical bearing member on a lateral side, and further comprises a laterally inclined surface between the flattened chordal portion and a surface of the cylindrical bearing member, and wherein the swivel base further comprises a rib protruding upwardly from the swivel base at a point axially to the rear of the raised lip, the rib engaging the laterally inclined surface and exerting a lateral force on the swivel rod tending to lift the ramp relative to the rib upon insertion of the swivel rod into the cylindrical passageway.

3. The mop swivel joint assembly of claim 1, further comprising an axial stop protruding from the swivel base at a space forward of the raised lip, the axial stop engaging against an axial end of the swivel connector upon complete insertion of the swivel connector into the cylindrical passageway.

4. The mop swivel joint assembly of claim 1, wherein the raised lip is dished along a centerline of the cylindrical passageway.

5. The mop swivel joint assembly of claim 1, wherein the cylindrical passageway is defined by at least one arch protruding upwardly from the swivel base, and wherein the raised lip is provided on the swivel base at a from of the arch.

6. The mop swivel joint assembly of claim 5, wherein said swivel socket means comprises two spaced arches protruding from the swivel base.

7. The mop swivel joint assembly of claim 1, wherein the swivel connector comprises a plurality of discs aligned perpendicular to an axis of the passageway, the disc being connected by axial webs extending radially to define the cylindrical bearing member, said circumferential groove being defined between two distal ones of the discs.

8. The mop swivel joint assembly of claim 1, wherein the handle receptacle and the swivel rod are inclined at an angle relative to one another, such that the handle receptacle in a normal use position protrudes generally upwardly from the swivel base, and wherein the ramp is disposed on a side of the swivel rod that is angularly spaced from the raised lip when the handle protrudes generally upwardly, such that the swivel connector is rotated toward the swivel base to align the ramp and the raised lip.

9. The mop swivel joint assembly of claim 8, wherein the ramp is disposed on a top side of the swivel rod facing the handle receptacle, such that the swivel connector is rotated upside down on the swivel base to align the ramp and the raised lip.

10. The mop swivel joint assembly of claim 1, wherein the ramp is a rounded surface.

11. A mop swivel joint assembly, comprising:

a swivel base generally defining a plane and including means for attachment of mop material;

a swivel socket on the swivel base the swivel socket having a cylindrical passageway, an unrestricted rearward opening and a restricted forward opening including a raised lip protruding from the swivel base to rotatably engage a swivel connector;

the swivel connector having a front end and a rear end, the rear end including a receptacle for a handle and the front end including a swivel rod, the swivel rod defining a substantially cylindrical bearing member including a grooved end having a circumferential groove adjacent the front end of the swivel rod;

at least one ramp at an axial forward portion of the grooved end of the wherein the ramp is disposed on a side of the swivel rod aligned to the raised lip only at a predetermined rotational position of the swivel rod in the cylindrical passageway, the ramp engaging the raised lip for passage into the circumferential groove when the swivel rod is at said rotational position, and being angularly spaced from the raised lip at other rotational positions, such that the swivel connector is rotated to said rotational position to align the amp and the raised lip; and, wherein the swivel rod is flattened along a side of the swivel rod extending rearwardly from a top edge of the ramp, forming a flattened part of the swivel rod, and wherein said flattened part is axially shorter than the cylindrical passageway.

12. The mop swivel joint assembly of claim 11, wherein the swivel rod is divided by the circumferential groove into a grooved end member having the ramp, and a proximal member, wherein the flattened side is along a surface of the proximal member and extends onto at least an axially forward portion of the proximal member.

13. A mop construction, comprising:

a mop head having dust collection material mounted on a swivel base, the swivel base substantially defining a plane parallel to a surface to be cleaned and having a swivel socket defining a cylindrical passageway with an axis substantially parallel to the plane, the cylindrical passageway having an unrestricted rearward opening and a restricted forward opening by a raised lip protruding from the swivel base;

a swivel connector having a front end and a rear end, the rear end including handle receptacle, and the front end including a swivel rod coupled to the handle receptacle at an angle relative to the swivel rod at a rearward end of the swivel rod such that the handle receptacle in a normal use position protrudes generally upwardly from the swivel base, the swivel rod defining a substantially cylindrical bearing member for rotatable reception of the swivel rod in the cylindrical passageway, the swivel rod having a circumferential groove adjacent a front end of the swivel rod; and, a substantially planar ramp formed on an axial forward portion of the front end of the swivel rod, wherein the ramp is arranged at an angle and aligned to the raised lip at a rotational position of the swivel rod in the cylindrical passageway to guide the ramp over the raised lip when the swivel rod is rotated to said rotational position to align the ramp to the raised lip, and wherein the ramp is disposed on a side of the swivel rod that is angularly spaced from the raised lip when the handle protrudes generally upward, such that the swivel connector is rotated toward the swivel base to align the ramp and the raised lip.

14. The mop configuration according to claim 13, wherein the swivel rod is flattened from the ramp rearwardly, forming a transverse chordal surface aligned to the ramp.

15. The mop configuration according to claim 14, wherein the ramp and the chordal surface are aligned to face along the angle of the handle receptacle, whereby the handle receptacle is rotated downwardly toward the swivel base to align the ramp and chordal surface with the raised lip.

16. The mop configuration according to claim 15, wherein the swivel rod further comprises a laterally inclined surface between the transverse chordal surface and the cylindrical bearing member, and wherein the swivel base further comprises a rib protruding upwardly from the swivel base at an axial space to the rear of the raised lip, a distance between the ramp and the taper being substantially equal to a distance between the raised lip and the rib, such that the laterally inclined surface engages the rib tending to lift the ramp relative to the raised lip upon insertion of the swivel rod into the cylindrical passageway.

17. The mop configuration according to claim 13, wherein the swivel socket comprises two arches defining the passageway, and wherein the raised lip is disposed at a front of one of the arches.

18. The mop configuration according to claim 13, wherein the raised lip is dished along a center of the passageway.

19. A mop swivel joint assembly, comprising:

a swivel base generally defining a plane and including means for attachment of mop material;

a swivel socket on the swivel base, the swivel socket having a cylindrical passageway, an unrestricted rearward opening and a restricted forward opening including a raised lip protruding from the swivel base to rotatably engage a swivel connector;

a swivel connector having a front end and a rear end, the rear end including a receptacle for a handle and the front end including a swivel rod, the swivel rod defining a substantially cylindrical bearing member including a grooved end having a circumferential groove adjacent the front end of the swivel rod;

a ramp at an axial forward portion of the grooved end of the swivel connector, wherein the ramp is aligned to the raised lip at a rotational position of the swivel rod in the cylindrical passageway, the ramp engaging the raised lip for passage into the circumferential groove when the swivel rod is at said rotational position; and, wherein the swivel rod further comprises a flattened chordal portion extending axially rearwardly from an edge of the ramp to the cylindrical bearing member on a lateral side, and further comprising a laterally inclined surface between the flattened chordal portion and a surface of the cylindrical bearing member, and wherein the swivel base further comprises a rib protruding upwardly from the swivel base at a point axially to the rear of the raised lip, the laterally inclined surface engaging the rib to exert a lateral force on the swivel rod tending to lift the ramp relative to the raised lip upon insertion of the swivel rod into the cylindrical passageway.

* * * * *